US011833817B2

(12) United States Patent
Minami et al.

(10) Patent No.: US 11,833,817 B2
(45) Date of Patent: Dec. 5, 2023

(54) LIQUID EJECTION HEAD SUBSTRATE AND LIQUID EJECTION HEAD

(71) Applicant: CANON KABUSHIKI KAISHA, Tokyo (JP)

(72) Inventors: Seiko Minami, Saitama (JP); Kenji Takahashi, Kanagawa (JP); Mai Hirohara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 17/521,629

(22) Filed: Nov. 8, 2021

(65) Prior Publication Data

US 2022/0153026 A1 May 19, 2022

(30) Foreign Application Priority Data

Nov. 13, 2020 (JP) ..... 2020-189848

(51) Int. Cl.
*B41J 2/14* (2006.01)

(52) U.S. Cl.
CPC ..... *B41J 2/14129* (2013.01); *B41J 2/14032* (2013.01); *B41J 2202/03* (2013.01)

(58) Field of Classification Search
CPC . B41J 2/14129; B41J 2/14032; B41J 2202/03
See application file for complete search history.

(56) References Cited

U.S. PATENT DOCUMENTS

| | | | | |
|---|---|---|---|---|
| 4,873,622 | A | 10/1989 | Komuro et al. | |
| 8,721,048 | B2 * | 5/2014 | Yasuda | B41J 2/14129 347/61 |
| 2013/0314474 | A1 | 11/2013 | Yasuda et al. | |
| 2017/0057228 | A1 | 3/2017 | Oikawa et al. | |

FOREIGN PATENT DOCUMENTS

| | | | |
|---|---|---|---|
| CN | 1223932 | A | 7/1999 |
| CN | 103373072 | A | 10/2013 |
| CN | 109203676 | A | 1/2019 |
| CN | 110869213 | A | 3/2020 |
| JP | 2002-046266 | A | 2/2002 |
| JP | 2017043098 | A | 3/2017 |

* cited by examiner

*Primary Examiner* — Geoffrey S Mruk
(74) *Attorney, Agent, or Firm* — Canon U.S.A., Inc., IP Division

(57) ABSTRACT

Long-term reliability of a liquid ejection head substrate and a liquid ejection head is improved by suppressing dissolution of an intermediate layer due to anodization. A liquid ejection head substrate including: a flow passage forming member having an ejection orifice and a flow passage; a heating resistance element for ejecting a liquid; an insulating layer covering the heating resistance element; a protecting layer whose surface is exposed to the flow passage; and an intermediate layer provided between the flow passage forming member and the protecting layer, in which the intermediate layer contains a material represented by a following composition formula (I): $Si_{w1}O_{x1}C_{y1}$ (I), $39 \leq w1 \leq 62$ (at. %), $32 \leq x1 \leq 55$ (at. %), and $6 \leq y1 \leq 29$ (at. %), and $w1+x1+y1=100$ (at %).

17 Claims, 3 Drawing Sheets

LIQUID EJECTION HEAD SUBSTRATE AND LIQUID EJECTION HEAD

BACKGROUND OF THE INVENTION

Field of the Invention

The present disclosure relates to a liquid ejection head substrate that ejects a liquid, and a liquid ejection head.

Description of the Related Art

One of recording methods using a typical ink jet head as a liquid ejection head is a method in which ink is heated by a heating element to bubble and the ink is ejected using bubbles.

An example of a liquid ejection head to which the above ejection method is applied is disclosed in Japanese Patent Application Laid-Open No. 2017-43098. The liquid ejection head disclosed in Japanese Patent Application Laid-Open No. 201743098 includes a flow passage forming member including a resin layer having an ejection orifice and a flow passage, a heating resistance element for ejecting a liquid, a substrate having a portion covering the heating resistance element, and a protecting layer exposing a surface of the portion to the flow passage, and an intermediate layer provided between the resin layer and the protecting layer and containing a carbon nitride silicon material.

A wiring for driving the heating resistance element is provided on the substrate. The heating resistance element and the wiring are insulated by an insulating layer covering the heating resistance element and the wiring so that the heating resistance element can be driven.

In Japanese Patent Application Laid-Open No. 201743098, in the liquid ejection head, a carbon nitride silicon material is applied to the intermediate layer between the resin layer included in the flow passage forming member and the protecting layer. In such a liquid ejection head, when used in a state where a voltage is accidentally applied to the protecting layer, since the carbon nitride silicon applied to the intermediate layer has no insulating property, the carbon nitride silicon may be anodized and dissolved in the ink. When the intermediate layer dissolves, there is a possibility that a nozzle may be peeled off and normal ejection may not be performed. Furthermore, the ink in which the intermediate layer is dissolved may enter the inside of the liquid ejection head and dissolve the insulating layer, which may lead to corrosion of the wiring. Therefore, the corrosion may lead to a disadvantage of the entire liquid ejection head. As described above, since the reliability of the liquid ejection head is lowered due to the dissolution of the intermediate layer, it is an issue to suppress the deterioration of the reliability.

SUMMARY OF THE INVENTION

Therefore, an aspect of the present disclosure is to provide a liquid ejection head substrate and a liquid ejection head that satisfy a performance required as an intermediate layer, such as adhesion to a flow passage forming member and a protecting layer, and an ink resistance, and have long-term reliability in which dissolution of the intermediate layer due to anodization is suppressed.

According to an aspect of the present disclosure, there is provided a liquid ejection head substrate including: a flow passage forming member having an ejection orifice and a flow passage; a heating resistance element for ejecting a liquid; an insulating layer covering the heating resistance element; a protecting layer provided on the insulating layer and whose surface is exposed to the flow passage; and an intermediate layer provided between the flow passage forming member and the protecting layer, in which the intermediate layer contains a material represented by the following composition formula (I):

$$Si_{w1}O_{x1}C_{y1} \quad (I)$$

in formula (I), $39 \leq w1 \leq 62$ (at. %), $32 \leq x1 \leq 55$ (at. %), $6 \leq y1 \leq 29$ (at. %), and $w1+x1+y1=100$ (at %).

In addition, according to another aspect of the present disclosure, there is provided a liquid ejection head substrate, in which the intermediate laver contains a material represented by the following composition formula (III):

$$Si_{w3}O_{x3}C_{y3}N_{z3} \quad (III)$$

in the above formula (III), $37 \leq w3 \leq 60$ (at. %), $30 \leq x3 \leq 53$ (at. %), $6 \leq y3 \leq 29$ (at. %), $4 \leq z \leq 9$ (at. %), and $w3+x3+y3+z3=100$ (at %).

According to still another aspect of the present disclosure, there is provided a liquid ejection head including the above-described liquid ejection head substrate.

According to the present disclosure, it is possible to provide the liquid ejection head substrate and the liquid ejection head that satisfy the performance required as the intermediate layer, such as adhesion to the flow passage forming member and the protecting layer, and the ink resistance, and have long-term reliability in which dissolution of the intermediate layer due to anodization is suppressed.

Further features of the present disclosure will become apparent from the following description of exemplary embodiments with reference to the attached drawings.

DESCRIPTION OF THE EMBODIMENTS

A liquid ejection head can be mounted on an information output device such as a printer, a copying machine, a facsimile having a communication system, a word processor having a printer unit, and an industrial recording device complexly combined with various processing devices. By using the liquid ejection head, recording can be performed on various recording target media such as paper, thread, fiber, cloth, metal, plastic, glass, wood, and ceramics.

"Recording" used in the present specification means not only applying an image having a meaning such as characters and figures to a recording target medium, but also applying an image having no meaning such as a pattern.

In addition, "liquid" used in the present specification required to be broadly interpreted, and includes not only the ink used for the recording operation but also the following liquid. That is, the "liquid" also includes a liquid used for forming an image, a design, and a pattern, processing the recording target medium, and processing ink and the recording target medium by being applied onto the recording target medium. Here, the processing of one of the ink and the recording target medium refers to, for example, processing for improving fixability by one of solidification and insolubilization of the coloring material in the ink applied to the recording target medium, improving one of recording quality and color development, and improving image durability. Furthermore, the "liquid" used in the liquid ejection head of the present disclosure normally contains a large amount of electrolyte and has conductivity.

Figure 1:
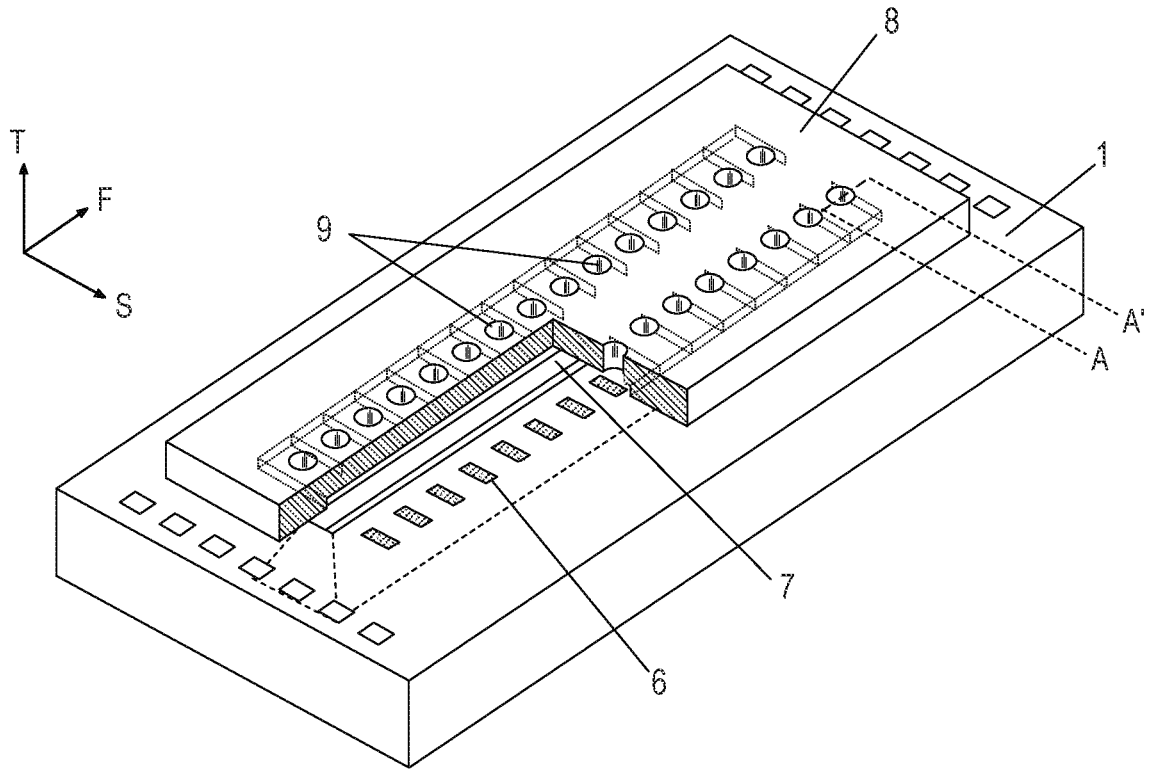
FIG. 1 is a perspective view illustrating an example of a liquid ejection head substrate according to an embodiment of the present disclosure.
Figure 2A:
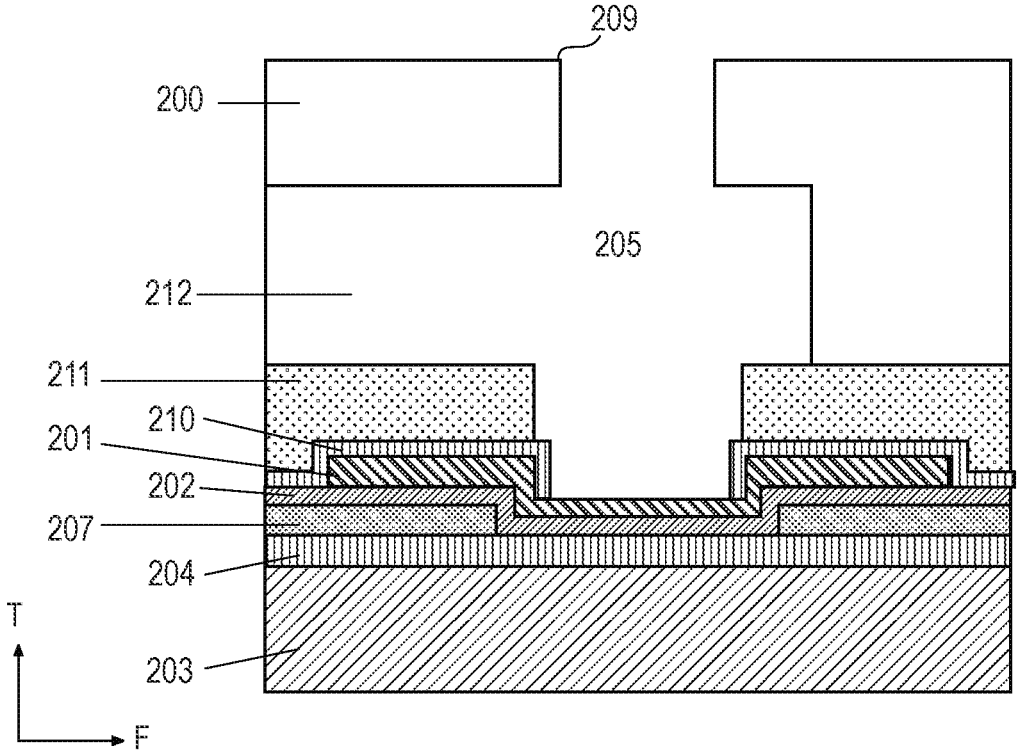
FIG. 2A is a cross-sectional view taken along line A-A' of the liquid ejection head substrate illustrated in FIG. 1.
Figure 2B:
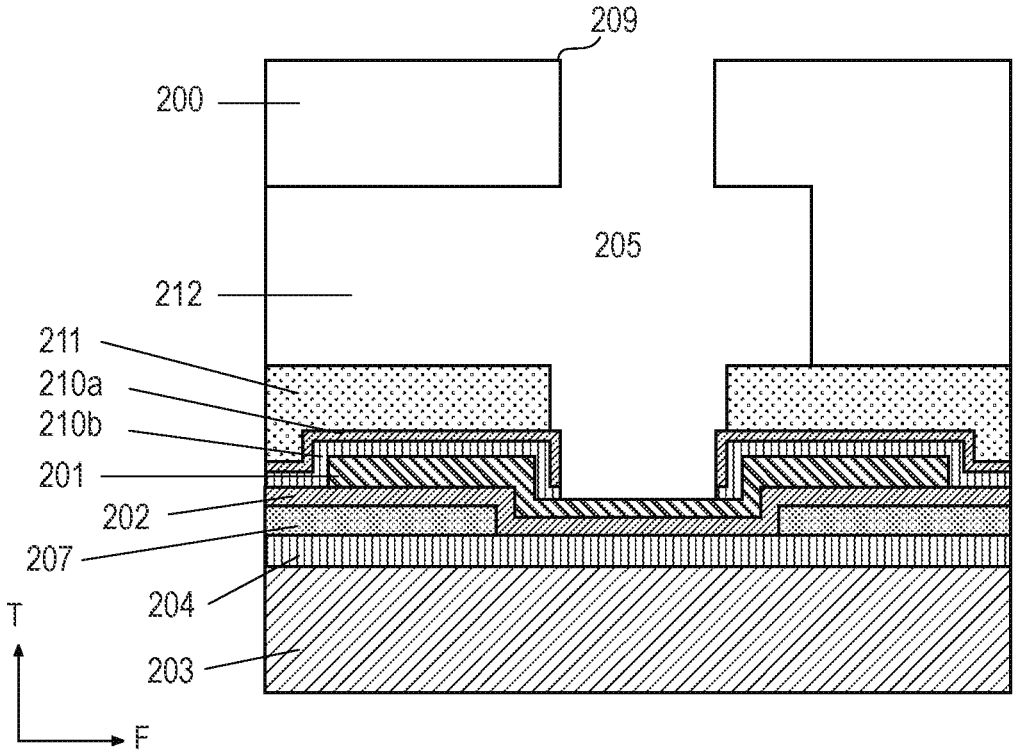
FIG. 2B is a cross-sectional view taken along line A-A' of the liquid ejection head substrate illustrated in FIG. 1.

Hereinafter, embodiments of the present disclosure will be described with reference to the drawings with reference to FIGS. 1, 2A, and 2B. FIG. 1 is a perspective view of a liquid ejection head substrate. FIGS. 2A and 2B are cross-sectional views taken along line A-A' of the liquid ejection head substrate of FIG. 1. Here, a row direction (longitudinal direction) of an ejection orifice is illustrated as a first direction (F), a width direction of a head substrate is illustrated as a second direction (S), and a thickness direction of the substrate is illustrated as a third direction (T).

FIG. 1 illustrates a partially broken portion of a main part of the liquid ejection head substrate. An element substrate 1 is provided with a heating resistance element 6 and a liquid supply port 7, and a flow passage forming member 8 having an ejection orifice 9 formed on the element substrate 1 is provided. In addition, as illustrated in FIGS. 2A and 2B, the element substrate 1 has a base material (not illustrated) made of Si, and has a multilayer wiring layer (not illustrated) on which a logic circuit (not illustrated) is formed. On an electrically insulating layer (heat storage layer) 203, which is an upper layer of the multilayer wiring layer, a heating resistance layer 204 constituting the heating resistance element 6 for generating thermal energy for ejecting a liquid and an electrode wiring 207 for driving the heating resistance element are provided. The liquid supplied from the liquid supply port 7 reaches a bubble chamber 205 from a flow passage 212, bubble s when thermal energy is applied by the heating resistance element 6, and is ejected from an ejection orifice 209 by the energy generated by the bubble. An insulating layer 202 is formed covering the heating resistance layer 204 and the electrode wiring 207, and a flow passage forming member 200 having a protecting layer 201 for cavitation resistance, the ejection orifice 209, and the flow passage 212 (including bubble chamber 205) is provided on the insulating layer 202. The surface of the protecting layer 201 is exposed to the flow passage.

In addition, an intermediate layer 210 containing a specific silicon carbonate material (described later) is provided between the flow passage forming member 200 and the protecting layer 201.

The insulating layer 202 is normally made of SiN and has a film thickness (dimension in the T direction) of approximately 150 nm to 300 nm. The insulating layer 202 may be made of one of SiO and SiC. The insulating layer 202 is covered with the protecting layer 201. The protecting layer 201 is made of a conductive material. The protecting layer 201 is normally made of Ta (tantalum) and has a film thickness of approximately 200 nm to 300 nm. The protecting layer 201 may be made of one of Ir (iridium) and a laminated film of Ir and Ta. In addition, although the figure illustrates a case where an organic intermediate layer 211 is formed between the flow passage forming member 200 and the intermediate layer 210, the organic intermediate layer 211 may be omitted.

The intermediate layer 210 is formed of a layer containing a material represented by the following composition formula (I).

$$Si_{w1}O_{x1}C_{y1} \quad (I)$$

[In the above formula (I), $39 \leq w1 \leq 62$ (at. %), $32 \leq x1 \leq 55$ (at. %), and $6 \leq y1 \leq 29$ (at. %), here, $w1+x1+y1=100$ (at %)].

When the liquid ejection head is used for a long period of time, a disadvantage may occur in the insulating layer 202 between the heating resistance element 6 and the protecting layer 201 accidentally, and the heating resistance element 6 and the protecting layer 201 may be conductive. As a result, the voltage applied to the heating resistance element 6 may be also applied to the protecting layer 201. However, even in a case where the protecting layer 201 of the liquid ejection head is used in a state where a voltage is accidentally applied, the intermediate layer 210 is formed with a layer containing a material represented by the composition formula (I) having a high insulating property. Therefore, it is possible to suppress ink dissolution of the intermediate layer 210 due to anodization. Therefore, it is possible to provide a liquid ejection head having long-term reliability.

Figure 3:
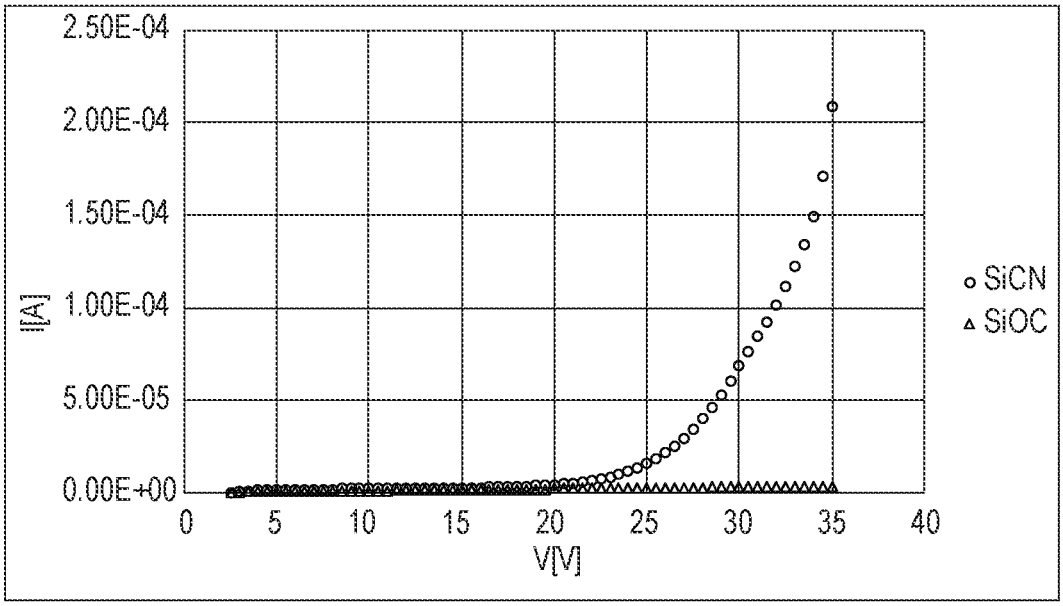
FIG. 3 is a graph illustrating a current that flows in a case where a voltage is applied to an intermediate layer.

An anodization mechanism will be described with reference to FIG. 3. FIG. 3 illustrates a current flowing through an electrode (not illustrated) when a voltage is accidentally applied to the protecting layer 201. In a case where the intermediate layer 210 is made of a carbon nitride silicon material such as SiCN, as illustrated in FIG. 3, it can be seen that the insulating property is low because a current flows when the voltage is high. That is, since the insulating property is not sufficient, anodization may occur when a voltage is accidentally applied to the protecting layer 201. On the other hand, in a case where the intermediate layer 210 contains the material of $Si_{w1}O_{x1}C_{y1}$ of the composition formula (I), as illustrated in FIG. 3, even when a voltage of up to 35 V is applied to this film, no current flows, so that it can be seen that the insulating property is high. When O is contained in the composition of the material constituting the intermediate layer in this manner, it can be seen that the insulating property increases. That is, since the insulating property is high, it can be seen that anodization is suppressed even when a voltage is accidentally applied to the protecting layer 201.

In order to further enhance the ink resistance of the intermediate layer 210, as illustrated in FIG. 2B, a layer having the ink resistance can be provided so as to cover the layer of the composition formula (I), and the intermediate layer 210 can have a two-laver configuration of an intermediate lower layer 210*b* and an intermediate upper layer 210*a*.

Specifically, the intermediate lower layer 210*b* is formed of a film containing the material represented by the composition formula (I), and the intermediate upper layer 210*a* is desirably formed of a film containing a material represented by the following composition formula (II).

$$Si_{w2}C_{y2}N_{z2} \quad (II)$$

[In the above formula (II), $30 \leq w2 \leq 59$ (at. %), $y2 \geq 5$ (at. %), and $z2 \geq 15$ (at. %) here, $w2+y2+z2=100$ (at %)].

The composition formula (II) is equivalent to the composition formula (I) disclosed in Japanese Patent Application Laid-Open No. 2017-43098, and the technical significance of the composition range is understood from Japanese Patent Application Laid-Open No. 2017-43098.

With such a configuration, in addition to the effect of suppressing the ink dissolution of the intermediate layer 210 due to the anodization by the insulating material of the composition formula (I) described above, the ink resistance can be further enhanced by the film of the composition formula (II). Therefore, the long-term reliability of the liquid ejection head can be further enhanced.

In addition, the insulating layer 202 can be made thin in order to drive the liquid ejection head with energy-saving. In such a case, there is a concern that the passivation resistance is insufficient, moisture and ions easily permeate, and corrosion of the electrode wiring 207 occurs. Therefore, the intermediate layer 210 also can have passivation resistance.

For example, the intermediate layer 210 can be formed of a film containing a material represented by the following composition formula (III):

$$Si_{w3}O_{x3}C_{y3}N_{z3} \quad \text{(III)}$$

[In the above formula (III), $37 \leq w3 \leq 60$ (at. %), $30 \leq x3 \leq 53$ (at. %), $6 \leq y3 \leq 29$ (at. %), and $4 \leq z3 \leq 9$ (at. %), here, $w3+x3+y3+z3=100$ (at %)].

With such a configuration, in addition to the effect of suppressing the ink dissolution of the intermediate layer 210 due to the anodization described above, the drive with energy-saving can be performed, so that the long-term reliability of the liquid ejection head driven with energy-saving can be enhanced.

In the intermediate layer 210, the film thickness of the film containing the material represented by the composition formula (I) is desirably 100 nm or more in order to ensure the insulating property. In addition, the film thickness of the film containing the material represented by the composition formula (II) is desirably 50 nm or more in order to ensure ink resistance. Furthermore, the film thickness of the layer containing the material represented by the composition formula (III) is desirably 100 nm or more in order to ensure the insulating property and the passivation resistance. However, when the protecting layer 201 is exposed to the flow passage, etching is performed to open the intermediate layer 210. Therefore, from the viewpoint of the selection ratio between the intermediate layer 210 and the protecting layer 201, the film thickness of the intermediate layer 210 is desirably 300 nm or less.

The $Si_{w1}O_{x1}C_{y1}$ (I), $Si_{w2}C_{y2}N_{z2}$ (II), and $Si_{w3}O_{x3}C_{y3}N_{z3}$ (III) films constituting the intermediate layer 210 can be formed by using a plasma CVD method.

Figure 4:
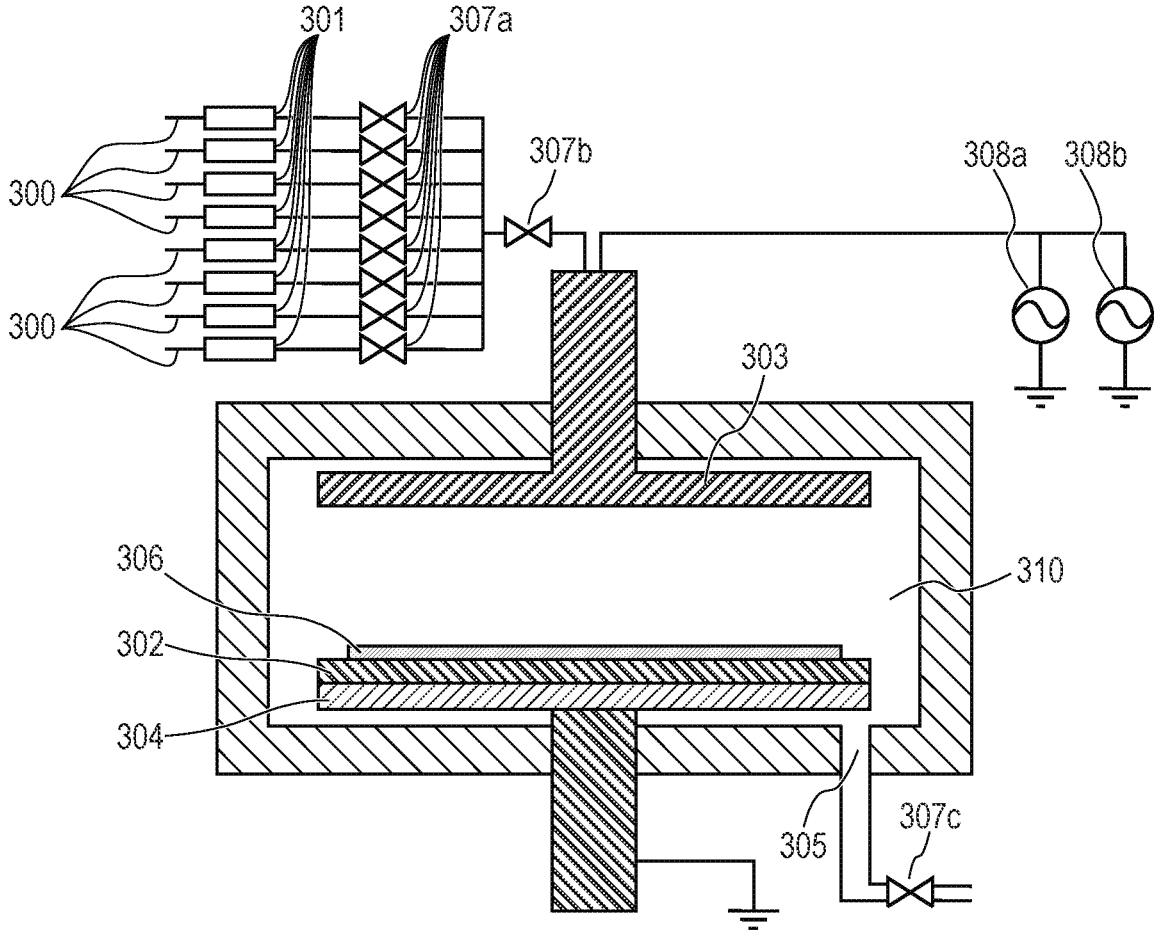
FIG. 4 is a cross-sectional view schematically illustrating a film forming device used for forming the intermediate layer.

FIG. 4 is a cross-sectional view schematically illustrating a film forming chamber of a plasma CVD apparatus used for forming the $Si_{w1}O_{x1}C_{y1}$ (I), $Si_{w2}C_{y2}N_{z2}$ (II), and $Si_{w3}O_{x3}C_{y3}N_{z3}$ (III) films.

The outline of the film forming method of the $Si_{w1}O_{x1}C_{y1}$ (I), $Si_{w2}C_{y2}N_{z2}$ (II), and $Si_{w3}O_{x3}C_{y3}N_{z3}$ (III) films will be described below with reference to FIG. 4.

First, the distance (GAP) between a shower head 303 that functions as an upper electrode during plasma discharge and a sample stage 302 that functions as a lower electrode is determined by adjusting the height of the sample stage 302. In addition, the temperature of the sample stage 302 is adjusted by heating with a heater 304.

Next, various gases to be used flow into a film forming chamber 310 via the shower head 303. At that time, the flow rates of the various gases are controlled by mass flow controllers 301 attached to each of pipes 300 corresponding to each of gases. Thereafter, by opening an introduction valve 307*a* of the gas to be used, the gas is mixed in the pipe and supplied to the shower head 303. Subsequently, an exhaust valve 307*b* attached to an exhaust port 305 connected to a vacuum pump (not illustrated) is adjusted to control the amount of exhaust, thereby maintaining the pressure in the film forming chamber 310 constant. Thereafter, the two-frequency RF power supplies 308*a* and 308*b* discharge the plasma between the shower head 303 and the sample stage 302. The atoms dissociated in the plasma are accumulated on a wafer 306 to form a film.

The $Si_{w1}O_{x1}C_{y1}$ (I) film according to the present disclosure can obtain $Si_{w1}O_{x1}C_{y1}$ (I) having different composition ratios by appropriately adjusting the film formation conditions of a flow rate of $SiH_4$ gas, a flow rate of $O_2$ gas, a flow rate of $CH_4$ gas, HRF power, LRF power, pressure, and temperature. Even when the flow rate ratio of each process gas was changed, $Si_{w1}O_{x1}C_{y1}$ (I) with $w1 \leq 38$ could not be prepared. In a case where stress suppression is required depending on the film composition and layout of the substrate, the stress suppression can be adjusted by raising the film formation temperature.

The $Si_{w2}C_{y2}N_{z2}$ (II) film according to the present disclosure can obtain $Si_{w2}C_{y2}N_{z2}$ (II) having different composition ratios by appropriately adjusting the film formation conditions of a flow rate of $SiH_4$ gas, a flow rate of $NH_3$ gas, a flow rate of $N_2$ gas, a flow rate of $CH_4$ gas, HRF power, LRF power, pressure, and temperature.

In order to obtain the $Si_{w3}O_{x3}C_{y3}N_{z3}$ (III) film according to the present disclosure, the film formation conditions of a flow rate of $SiH_4$ gas, a flow rate of $N_2O$ gas, a flow rate of $CH_4$ gas, HRF power, LRF power, pressure, and temperature are appropriately adjusted. As a result, $Si_{w3}O_{x3}C_{y3}N_{z3}$ (III) having different composition ratios can be obtained. Even when the flow rate ratio of each process gas was changed, the $Si_{w3}O_{x3}C_{y3}N_{z3}$ (III) film with $w3 \leq 36$ and the $Si_{w3}O_{x3}C_{y3}N_{z3}$ (III) film with $z3 \geq 10$ could not be prepared.

In this specification, $Si_{w1}O_{x1}C_{y1}$ (I), $Si_{w2}C_{y2}N_{z2}$ (II), and $Si_{w3}O_{x3}C_{y3}N_{z3}$ (III) indicate the content ratio of each element as an atomic percentage (at. %). In addition, although hydrogen derived from the raw material gas of the CVD method described above is contained, the hydrogen content is not taken into consideration. However, the film formed by using the raw material gas described above normally contains approximately 15 to 30 (at. %) of hydrogen, and hydrogen may be contained as long as the film does not deviate significantly from the range. Hereinafter, examples for determining the performance of $Si_{w1}O_{x1}C_{y1}$ (I), $Si_{w2}C_{y2}N_{z2}$ (II), and $Si_{w3}O_{x3}C_{y3}N_{z3}$ (III) are illustrated. In addition, in the following examples, the same experiment was carried outperformed using the SiO film as a reference level.

EXAMPLES

Hereinafter, the present disclosure will be further described with reference to Examples and Comparative Examples, and the present disclosure is not limited to these Examples.

Experimental Example 1

The following experiment was performed to confirm the erosion resistance of the $Si_{w1}O_{x1}C_{y1}$ (I) film and $Si_{w3}O_{x3}C_{y3}N_{z3}$ (III) film to the ink in the embodiment. First, the films of $Si_{w1}O_{x1}C_{y1}$ (I) and $Si_{w3}O_{x3}C_{y3}N_{z3}$ (III) were formed on separate silicon substrates. Thereafter, the substrates were cut so as to have a size of 20 mm×20 mm.

The amount of dissolution when the individual pieces were immersed in 30 ml of pigment ink having a pH of approximately 9 heated to 60° C. and left for 72 hours was examined. At that time, in order to eliminate the influence of dissolution of Si exposed on the end surface and the rear surface of the substrate, the rear surface and the side surface of the substrate were protected with an ink-insoluble resin.

The film thickness according to the experimental example was measured using a spectroscopic ellipsometer. By examining the variation in the film thickness in the experiment, the erosion resistance of the $Si_{w1}O_{x1}C_{y1}$ (I) film and $Si_{w3}O_{x3}C_{y3}N_{z3}$ (III) film to the ink was confirmed. The results are illustrated in Tables 1 and 2. The criteria for this experiment were as follows.

A: The amount of dissolution is less than 1 nm.

B: The amount of dissolution is 1 nm or more to less than 10 nm.

C: The amount of dissolution is 10 nm or more to less than 30 nm.

D: The amount of dissolution is 30 nm or more.

As a result of the determination at this time, it was assumed that A was significantly effective, B was effective. C was less effective, and D was substantially ineffective. This determination is the same as the results of the following experimental examples. Since the amount of dissolution of each sample a to k of the $Si_{w1}O_{x1}C_{y1}$ (I) film tended to be substantially the same as the amount of dissolution of each sample A to K of $Si_{w3}O_{x3}C_{y3}N_{z3}$ (III), only the determination result is illustrated in Table 1.

From the results illustrated in Table 1, it can be seen that the composition range of $Si_{w1}O_{x1}C_{y1}$ (I) satisfying the erosion resistance to ink is a composition region satisfying 6≤y1 (at. %). From the results illustrated in Table 2, it can be seen that the composition range of $Si_{w3}O_{x3}C_{y3}N_{z3}$ (III) satisfying the erosion resistance to ink is a composition region satisfying 6≤y3 (at. %). In particular, when using a pigment ink, it is effective to use $Si_{w1}O_{x1}C_{y1}$ (I), and $Si_{w3}O_{x3}C_{y3}N_{z3}$ (III) within the range of this composition region. In addition, even with a pigment ink and a dye ink having a pH of approximately 5 to 11, the same results as the above results were obtained.

TABLE 1

| Name of | $Si_{w1}O_{x1}C_{y1}$ | | | Determination of erosion resistance in Experimental |
|---|---|---|---|---|
| sample | w1 | x1 | y1 | Example 1 |
| a | 42 | 55 | 3 | D |
| b | 43 | 51 | 6 | C |
| c | 39 | 43 | 18 | A |
| d | 43 | 44 | 13 | B |
| e | 39 | 42 | 19 | A |
| f | 42 | 42 | 16 | A |
| g | 40 | 41 | 19 | A |
| h | 41 | 35 | 24 | A |
| i | 58 | 35 | 7 | C |
| j | 41 | 32 | 27 | A |
| k | 40 | 30 | 30 | A |
| L | | P—SiO | | D |

TABLE 2

| Name of | $Si_{w3}O_{x3}C_{y3}N_{z3}$ | | | | Amount of dissolution in Experimental | Determination of erosion resistance in Experimental |
|---|---|---|---|---|---|---|
| sample | w3 | x3 | y3 | z3 | Example 1 [nm] | Example 1 |
| A | 39 | 52 | 3 | 6 | 69.0 | D |
| B | 39 | 48 | 6 | 7 | 25.5 | C |
| C | 38 | 42 | 18 | 2 | 0.9 | A |
| D | 39 | 41 | 12 | 8 | 2.1 | B |
| E | 38 | 40 | 18 | 4 | 0.7 | A |
| F | 38 | 39 | 15 | 8 | 0.4 | A |
| G | 37 | 38 | 18 | 7 | 0.5 | A |

TABLE 2-continued

| Name of | $Si_{w3}O_{x3}C_{y3}N_{z3}$ | | | | Amount of dissolution in Experimental | Determination of erosion resistance in Experimental |
|---|---|---|---|---|---|---|
| sample | w3 | x3 | y3 | z3 | Example 1 [nm] | Example 1 |
| H | 38 | 33 | 22 | 7 | 0.1 | A |
| I | 53 | 32 | 6 | 9 | 29.1 | C |
| J | 38 | 30 | 25 | 7 | 0.9 | A |
| K | 37 | 28 | 28 | 7 | 0.6 | A |
| L | | P—SiO | | | 249.0 | D |

Experimental Example 2

The following experiments were performed to confirm the electrical insulating property of the $Si_{w1}O_{x1}C_{y1}$ (I) film, and $Si_{w3}O_{x3}C_{y3}N_{z3}$ (III) film in the embodiment. First, a metal layer having aluminum as a main material is formed with a thickness of 200 nm on a silicon substrate on which a silicon thermal oxide film having a film thickness of 1 μm is formed for use as a first electrode, and processed so as to have a size of 2.5 mm×2.5 mm. Thereafter, one film of $Si_{w1}O_{x1}C_{y1}$ (I) and $Si_{w3}O_{x3}C_{y3}N_{z3}$ (III) was formed to a thickness of 300 nm. Furthermore, a film having aluminum as a main material is processed into a film having a size of 2 mm×2 mm in the upper layer for use as a second electrode, and is formed with a thickness of 200 nm so as not to protrude directly above the first electrode. Thereafter, through-holes for making electrical contact with the first electrode were opened to the $Si_{w1}O_{x1}C_{y1}$ (I) film and the $Si_{w3}O_{x3}C_{y3}N_{z3}$ (III) film. Using such a sample, the amount of current when a voltage of 32 V was applied between the first electrode and the second electrode was measured. By measuring the amount of current in this experiment, the electrical insulating property of the $Si_{w1}O_{x1}C_{y1}$ (I) film and $Si_{w3}O_{x3}C_{y3}N_{z3}$ (III) film was confirmed. The results are illustrated in Tables 3 and 4. The criteria for this experiment were as follows.

A: The amount of current is less than 0.1 nA.

B: The amount of current is 0.1 nA or more to less than 10 nA.

C: The amount of current is 10 nA or more to less than 100 nA.

D: The amount of current is 100 nA or more.

Since the current values of each sample a to k of the $Si_{w1}O_{x1}C_{y1}$ (I) film tended to be substantially the same as the current values of each sample A to K of $Si_{w3}O_{x3}C_{y3}N_{z3}$ (III) film, only the determination result is illustrated in Table 3.

From the results illustrated in Table 3, it can be seen that the composition range of the $Si_{w1}O_{x1}C_{y1}$ (I) film satisfying the electrical insulating property is a composition region satisfying 32≤x1 (at. %). From the results illustrated in Table 4, it can be seen that the composition range of $Si_{w3}O_{x3}C_{y3}N_{z3}$ (III) satisfying the electrical insulating property is a composition region satisfying 30≤x3 (at. %).

TABLE 3

| Name of | $Si_{w1}O_{x1}C_{y1}$ | | | Determination of insulating property in Experimental |
|---|---|---|---|---|
| sample | w1 | x1 | y1 | Example 2 |
| a | 42 | 55 | 3 | A |
| b | 43 | 51 | 6 | A |
| c | 39 | 43 | 18 | A |
| d | 43 | 44 | 13 | A |

TABLE 3-continued

| Name of sample | $Si_{w1}O_{x1}C_{y1}$ w1 | x1 | y1 | Determination of insulating property in Experimental Example 2 |
|---|---|---|---|---|
| e | 39 | 42 | 19 | A |
| f | 42 | 42 | 16 | B |
| g | 40 | 41 | 19 | B |
| h | 41 | 35 | 24 | B |
| i | 58 | 35 | 7 | C |
| j | 41 | 32 | 27 | C |
| k | 40 | 30 | 30 | D |
| L | P—SiO | | | A |

TABLE 4

| Name of sample | $Si_{w3}O_{x3}C_{y3}N_{z3}$ w3 | x3 | y3 | z3 | Current value in Experimental Example 2 [nA] | Determination of insulating property in Experimental Example 2 |
|---|---|---|---|---|---|---|
| A | 39 | 52 | 3 | 6 | 0.08 | A |
| B | 39 | 48 | 6 | 7 | 0.09 | A |
| C | 38 | 42 | 18 | 2 | 0.09 | A |
| D | 39 | 41 | 12 | 8 | 0.07 | A |
| E | 38 | 40 | 18 | 4 | 0.08 | A |
| F | 38 | 39 | 15 | 8 | 0.14 | B |
| G | 37 | 38 | 18 | 7 | 0.17 | B |
| H | 38 | 33 | 22 | 7 | 4.99 | B |
| I | 53 | 32 | 6 | 9 | 20.0 | C |
| J | 38 | 30 | 25 | 7 | 45.47 | C |
| K | 37 | 28 | 28 | 7 | 121.62 | D |
| L | P—SiO | | | | 0.07 | A |

Experimental Example 3

One of the stress adjustment methods is the film formation temperature. The stress of SiOC can be suppressed by raising the film formation temperature. Since SiOCN has nitrogen to suppress stress, film formation can be performed at a film formation temperature lower than that of SiOC.

The following experiment was performed to measure the stress of the $Si_{w3}O_{x3}C_{y3}N_{z3}$ (III) film in the present disclosure. A $Si_{w3}O_{x3}C_{y3}N_{z3}$ (III) film was formed on a silicon substrate, and the stress was measured with a stress measuring instrument. The results are illustrated in Table 5. When the stress value is 0 or more, it represents tensile stress, and when the stress value is less than 0, it represents compressive stress. The criteria for this experiment are as follows.

A: The absolute value of stress is less than 150 MPa.

B: The absolute value of stress is 150 MPa or more to less than 400 MPa.

C: The absolute value of stress is 400 MPa or more to less than 500 MPa.

D: The absolute value of stress is 500 MPa or more. From the results illustrated in Table 5, it can be seen that the composition range of the $Si_{w3}O_{x3}C_{y3}N_{z3}$ (III) film satisfying the low stress is a composition region satisfying 4≤z3 (at. %).

TABLE 5

| Name of sample | $Si_{w3}O_{x3}C_{y3}N_{z3}$ w3 | x3 | y3 | z3 | Stress in Experimental Example 3 [MPa] | Determination of stress in Experimental Example 3 |
|---|---|---|---|---|---|---|
| A | 39 | 52 | 3 | 6 | −60 | A |
| B | 39 | 48 | 6 | 7 | −69 | A |
| C | 38 | 42 | 18 | 2 | −581 | D |
| D | 39 | 41 | 12 | 8 | −104 | A |
| E | 38 | 40 | 18 | 4 | −497 | C |
| F | 38 | 39 | 15 | 8 | −143 | A |
| G | 37 | 38 | 18 | 7 | −353 | B |
| H | 38 | 33 | 22 | 7 | −250 | B |
| I | 53 | 32 | 6 | 9 | −80 | A |
| J | 38 | 30 | 25 | 7 | −335 | B |
| K | 37 | 28 | 28 | 7 | −378 | B |
| L | P—SiO | | | | −112 | A |

The experimental results of Experimental Examples 1 to 3 described above are summarized in Tables 6 and 7. Table 6 is the experimental results of $Si_{w1}O_{x1}C_{y1}$ (I), and Table 7 is the experimental results of $Si_{w3}O_{x3}C_{y3}N_{z3}$ (III). For the comprehensive determination, the determination of the one with the lowest evaluation among the results of each experiment was used. The intermediate layer 210 of the liquid ejection head is required to have excellent performances listed in Experimental Examples 1 to 3 above.

The composition range of the $Si_{w1}O_{x1}C_{y1}$ (I) film is defined as follows. An $Si_{w1}O_{x1}C_{y1}$ (I) film with w1≤38 could not be prepared. From Table 6, the composition of the $Si_{w1}O_{x1}C_{y1}$ (I) film is 32≤x1 (at. %), and 6≤y1 (at. %) with w1+x1+y1=100 (at %). As a result, the composition of the $Si_{w1}O_{x1}C_{y1}$ (I) film is 39≤w1 (at. %), 32≤x1 (at. %), and 6≤y1 (at. %) as w1+x1+y1=100 (at %) so as to satisfy each performance. Since w1+x1+y1=100 (at %), each of the upper limits of w1, x1, and y1 is w1≤62 (at. %), x1≤55 (at %), and y1≤29 (at %). Therefore, the composition of the $Si_{w1}O_{x1}C_{y1}$ (I) film capable of exhibiting the required performance is 39≤w1≤62 (at. %), 32≤x1≤55 (at. %), and 6≤y1≤29 (at. %) as w1+x1+y1=100 (at %).

In addition, the levels at which the comprehensive determination was A and B were the levels of c, d, e, f, g, and h. As a result, in $Si_{w1}O_{x1}C_{y1}$ (I), a relational formula of 39≤w1≤43 (at. %), 35≤x1≤44 (at. %), and 13≤y1≤24 (at. %) can be satisfied.

The composition range of the $Si_{w3}O_{x3}C_{y3}N_{z3}$ (III) film is defined as follows. A $Si_{w3}O_{x3}C_{y3}N_{z3}$ film with w3≤36 and z3≥10 could not be prepared. From Table 7, the composition of the $Si_{w3}O_{x3}C_{y3}N_{z3}$ (III) film is 30≤x3 (at. %), 6≤y3 (at. %), and 4≤z3 (at. %) as w3+x3+y3+z3=100 (at %). AS a result, the composition of the $Si_{w3}O_{x3}C_{y3}N_{z3}$ film is 37≤w3 (at. %), 30≤x3 (at. %), 6≤y3 (at. %), and 4≤z3≤9 (at. %) as w3+x3+y3+z3=100 (at %) so as to satisfy each performance. Since w3+x3+y3+z3=100 (at %), each of the upper limits of w3, x3, and y3 is w3≤60 (at. %), x3≤53 (at %), and 3≤29 (at %). Therefore, the composition of the $Si_{w3}O_{x3}C_{y3}N_{z3}$ film capable of exhibiting the required performance is as follows. That is, 37≤w3≤60 (at. %), 30≤x≤53 (at. %), 6≤y3≤29 (at. %), and 4≤z3≤9 (at. %) as w3+x3+y3+z3=100 (at %).

In addition, the levels at which the comprehensive determination was B or more were the levels D, F, G, and H. As a result, in $Si_{w3}O_{x3}C_{y3}N_{z3}$, 37≤w3≤39 (at. %), a relational formula of 33≤x3≤41 (at. %), 12≤y3≤22 (at. %), and 7≤z3≤8 (at. %) can be satisfied.

TABLE 6

| Name of sample | $Si_{w1}O_{x1}C_{y1}$ w1 | x1 | y1 | Determination of erosion resistance | Determination of insulating property | Comprehensive determination |
|---|---|---|---|---|---|---|
| a | 42 | 55 | 3 | D | A | D |
| b | 43 | 51 | 6 | C | A | C |
| c | 39 | 43 | 18 | A | A | A |
| d | 43 | 44 | 13 | B | A | B |
| e | 39 | 42 | 19 | A | A | A |
| f | 42 | 42 | 16 | A | B | B |
| g | 40 | 41 | 19 | A | B | B |
| h | 41 | 35 | 24 | A | B | B |
| i | 53 | 35 | 7 | C | C | C |
| j | 41 | 32 | 27 | A | C | C |
| k | 40 | 30 | 30 | A | D | D |
| L | P—SiO | | | D | A | D |

TABLE 7

| Name of sample | $Si_{w3}O_{x3}C_{y3}N_{z3}$ w3 | x3 | y3 | z3 | Determination of erosion resistance | Determination of insulating property | Determination of stress | Comprehensive determination |
|---|---|---|---|---|---|---|---|---|
| A | 39 | 52 | 3 | 6 | D | A | A | D |
| B | 39 | 48 | 6 | 7 | C | A | A | C |
| C | 38 | 42 | 18 | 2 | A | A | D | D |
| D | 39 | 41 | 12 | 8 | B | A | A | B |
| E | 38 | 40 | 18 | 4 | A | A | C | C |
| F | 38 | 39 | 15 | 8 | A | B | A | B |
| G | 37 | 38 | 18 | 7 | A | B | B | B |
| H | 38 | 33 | 22 | 7 | A | B | B | B |
| I | 53 | 32 | 6 | 9 | C | C | A | C |
| J | 38 | 30 | 25 | 7 | A | C | B | C |
| K | 37 | 28 | 28 | 7 | A | D | B | D |
| L | P—SiO | | | | D | A | A | D |

Example 1

The liquid was actually ejected using various liquid ejection heads prepared in the present embodiment. In this example, the intermediate layer 210 was formed of a single layer of one of $Si_{w1}O_{x1}C_{y1}$ film and $Si_{w3}O_{x3}C_{y3}N_{z3}$ film. The results are illustrated below.

The intermediate layer 210 formed of the materials of the levels b to j illustrated in Table 6 has an insulating property. Therefore, even in a case where the liquid ejection head was used in a state where a voltage was accidentally applied, it was possible to suppress the ink dissolution of the intermediate layer 210 due to anodization, and the liquid ejection head having the intermediate layer 210 formed of the materials of the levels of b to j had long-term reliability. In particular, in a case where the materials having the levels of c to h were used for the intermediate layer 210, both the erosion resistance and the insulating property were determined to be B or more, so that a liquid ejection head having higher reliability could be formed.

On the other hand, in the liquid ejection head using the materials of the levels a and l for the intermediate layer 210, when the ejection is continued for a long period of time, the intermediate layer 210 may be dissolved in the ink and the ejection performance may be lowered. Due to the dissolution of the intermediate layer 210, the nozzle was peeled off and normal ejection could not be performed, in some cases. Furthermore, the ink invades and dissolves the insulating layer 202, which leads to corrosion of the wiring 207, so that a disadvantage might occur in the entire liquid ejection head. In addition, although the liquid ejection head using the material of the k level for the intermediate layer 210 did not normally cause a defect, in a case where it was used in a state where a voltage was accidentally applied, since the insulating property of the intermediate layer 210 was poor, the intermediate layer 210 was anodized and dissolved in the ink. Due to the dissolution of the intermediate layer 210, the nozzle was peeled off and normal ejection could not be performed, in some cases. Furthermore, the ink invades and dissolves the insulating layer 202, which leads to corrosion of the wiring 207. Therefore, the corrosion may lead to a disadvantage of the entire liquid ejection head.

The intermediate layer 210 formed of the materials of the levels B, and D to J illustrated in Table 7 has an insulating property. Therefore, the liquid ejection head having the intermediate layer 210 formed of the materials of the levels B, and D to J can suppress the ink dissolution of the intermediate layer 210 due to anodization even in a case where the liquid ejection head is used in a state where a voltage is accidentally applied. Therefore, it was possible to form a liquid ejection head having long-term reliability. In particular, in a case where the materials having the levels of D. and F to H were used for the intermediate layer, the erosion resistance, the insulating property, and the stress were all B-determination or more, so that a liquid ejection head having higher reliability could be formed.

On the other hand, in the liquid ejection head using the materials of the levels A and L for the intermediate layer 210, when the ejection is continued for a long period of time, the intermediate layer 210 may be dissolved in the ink and the ejection performance may be lowered. Due to the dissolution of the intermediate layer 210, the nozzle was peeled off and normal ejection could not be performed, in some cases. Furthermore, the ink invades and dissolves the insulating layer 202, which leads to corrosion of the wiring 207, so that a disadvantage might occur in the entire liquid ejection head. Although the liquid ejection head using the material of the level C for the intermediate layer 210 did not cause a defect, the warp of the substrate was increased, and a transfer error and a suction error occurred in a part of the head manufacturing step. In addition, although the liquid ejection head using the material of level K for the intermediate layer 210 did not normally cause a defect, in a case where the liquid ejection head was used in a state where a voltage was accidentally applied, the insulating property of the intermediate layer 210 was poor. Therefore, the intermediate layer 210 was anodized and dissolved in the ink. Due to the dissolution of the intermediate layer 210, the nozzle was peeled off and normal ejection could not be performed, in some cases. Furthermore, the ink invades and dissolves the insulating layer 202, which leads to corrosion of the wiring 207, so that a disadvantage might occur in the entire head.

Example 2

Next, Example 2 of the present disclosure will be described with reference to FIG. 2A. As illustrated in FIG. 2A, the insulating layer 202 was made of one of SiN and SiO and had a film thickness of 300 nm. The insulating layer 202 was covered with a Ta protecting layer 201 having a film thickness of 200 nm, and the protecting layer 201 was patterned so as to remain in the region facing the bubble chamber 205. The protecting layer 201 was covered and the intermediate layer 210 was formed with a material represented by the composition formula (I): $Si_{w1}O_{x1}C_{y1}$ (I) to a film thickness of 100 nm by a plasma CVD method. Here, the film made of the material represented by the composition formula (I) was formed with w1, x1, and y1 as w1=42 (at. %), x1=42 (at. %), and y1=16 (at. %), respectively. In order to ensure the insulating property of the intermediate layer 210, the intermediate layer 210 can have a film thickness of 100 nm or more. Thereafter, in order to expose the protecting layer 201, the intermediate layer 210 at the portion corresponding to the bubble chamber was removed. Furthermore, an organic intermediate layer 211 made of a polyether amide resin was formed.

The flow passage forming member 200 having a side wall portion and a ceiling portion of the flow passage 212 and the ejection orifice 209 was formed on the substrate as a cured product layer of the photosensitive resin material. The photosensitive resin material is not particularly limited, and can be selected and used from those used for the flow passage forming member of the recording head. A portion made of another material may be further added to the portion made of the resin layer of the flow passage forming member. For example, the surface of the ejection orifice to be opened may be surface-treated by forming a water-repellent layer.

As illustrated in FIG. 1, the flow passage forming member and the substrate are joined via a joint portion provided in a portion other than the flow passage. The joint portion is formed to include a portion in which an electrical insulating layer 202, the protecting layer 201, the intermediate layer 210, and the organic intermediate layer 211 on the substrate side are laminated, and the flow passage forming member 200 made of a resin layer. These joints can be performed by forming a pattern of the flow passage forming member on the substrate with a photosensitive resin material, curing the pattern by exposure, and further heat-curing the pattern if necessary. The ejection orifice 209 may be formed by exposure and may be formed by using a laser.

Example 3

Next, Example 3 of the present disclosure will be illustrated only a portion different from that of Example 2. As illustrated in FIG. 2B, the intermediate lower layer 210*b* was formed with a film thickness of 100 nm using the material of the composition formula (I)(here, the same material as that in Example 2). Furthermore, in order to further enhance the ink resistance, a film made of a material represented by the composition formula (II) having ink resistance was formed so as to cover the intermediate lower layer 210*b*. The film thickness of the film made of the material represented by the composition formula (II) was set to 50 nm in order to ensure ink resistance. The film represented by the composition formula (II): $Si_{w2}C_{y2}N_{z2}$ (II) was formed of a film in which x2, y2, and z2 were w2=47 (at. %), y2=17 (at. %), and z2=36 (at. %). With such a configuration, even in a case where the protecting layer 201 of the liquid ejection head was used in a state where a voltage was accidentally applied, the intermediate lower layer 210*b* in contact with the protecting layer had an insulating property. Therefore, it was possible to suppress the ink dissolution due to the anodization. Furthermore, the intermediate upper layer 210*a* was provided, so that the ink resistance as the intermediate layer could be improved. From these points, the long-term reliability of the liquid ejection head could be improved.

Example 4

Next, Example 4 of the present disclosure will be illustrated only a portion different from that of Example 2. In order to drive the liquid ejection head with energy-saving, the film thickness of the insulating layer 202 was reduced to 170 nm. However, there is a concern that the passivation resistance is insufficient, moisture and ions easily permeate, and the electrode wiring 207 may be corroded. Therefore, in order to impart the intermediate layer passivation resistance, the configuration of the intermediate layer 210 was changed as follows. The intermediate layer 210 was formed of a film containing a material in which w3, x3, y3, and z3 are w3=38 (at. %), x3=39 (at. %), y3=15 (at. %), z3=8 (at. %) in the composition formula (III): $Si_{w3}O_{x3}C_{y3}N_{z3}$ (III). In the intermediate layer 210, the film thickness of the film made of the material represented by the composition formula (III) was set to 100 nm in order to ensure the insulating property and the passivation resistance. With this configuration, even in a case where the protecting layer 201 of the liquid ejection head was used in a state where a voltage was accidentally applied, the intermediate layer 210 had an insulating property. Therefore, it was possible to suppress the ink dissolution of the intermediate layer 210 due to anodization. Furthermore, the film thickness of the insulating layer 202 was reduced, so that driving can be performed with energy-saving.

Comparative Example 1

Next, Comparative Example 1 of the present disclosure is illustrated only a portion different from that of Example 1. The configuration of the intermediate layer 210 was changed as follows.

The intermediate layer 210 was formed of a film made of a material in which x2, y2, and z2 are w2=47 (at. %), y2=17 (at. %), and z2=36 (at. %) in the composition formula (II): $Si_{w2}C_{y2}N_{z2}$ (II). The film thickness was 100 nm.

With this configuration, in a case where the protecting layer 201 of the liquid ejection head is used in a state where a voltage is accidentally applied, the intermediate layer 210 has a poor insulating property. Therefore, the intermediate layer 210 may be anodized and dissolved in the ink. Due to the dissolution of the intermediate layer 210, the nozzle is peeled off and normal ejection cannot be performed. Furthermore, the ink invades and dissolves the insulating layer 202, which leads to corrosion of the wiring 207, so that a disadvantage was occurred in the entire head.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-189848, filed Nov. 13, 2020, which is hereby incorporated by reference herein in its entirety.

What is claimed is:

1. A liquid ejection head substrate comprising:

a flow passage forming member having an ejection orifice and a flow passage;

a heating resistance element for ejecting a liquid;

an insulating layer covering the heating resistance element;

a conductive protecting layer provided on or above the insulating layer and whose surface is exposed to the flow passage; and an intermediate layer provided between the flow passage forming member and the conductive protecting layer, wherein the intermediate layer contains a material represented by the following composition formula (I):

$$Si_{w1}O_{x1}C_{y1} \quad (I)$$

in formula (I), 39≤w1≤62 at. %, 32≤x1≤55 at. %, 6≤y1≤29 at. %, and w1+x1+y1=100 at %.

2. The liquid ejection head substrate according to claim 1, wherein w1, x1, and z1 in the composition formula (I) satisfy the following relational formula:

39≤w1≤43 at. %,

35≤x1≤44 at. %, and

13≤y1≤24 at. %.

3. The liquid ejection head substrate according to claim 1, wherein the intermediate layer has a layer made of the material represented by the composition formula (I), and a film thickness of the intermediate layer is 100 nm or more.

4. The liquid ejection head substrate according to claim 1, wherein the intermediate layer includes a lower layer in contact with the conductive protecting layer and an upper layer covering the lower layer, the lower layer contains the material represented by the composition formula (I), and the upper layer contains a material represented by the following composition formula (II):

$$Si_{w2}C_{y2}N_{z2} \quad (II)$$

in formula (II), 30≤w2≤59 at. %, y2≥5 at. %, z2≥15 at. %, and w2+y2+z2=100 at %.

5. The liquid ejection head substrate according to claim 4, wherein the upper layer of the intermediate layer is a layer made of the material represented by the composition formula (II), and a film thickness of the upper layer is 50 nm or more.

6. The liquid ejection head substrate according to claim 1, wherein a film thickness of the intermediate layer is 300 nm or less.

7. The liquid ejection head substrate according to claim 1, wherein the conductive protecting layer contains tantalum.

8. The liquid ejection head substrate according to claim 1, wherein the conductive protecting layer contains iridium.

9. The liquid ejection head substrate according to claim 1, further comprising:

an organic intermediate layer between the flow passage forming member and the intermediate layer.

10. A liquid ejection head comprising:

a liquid ejection head substrate including a flow passage forming member having an ejection orifice and a flow passage, a heating resistance element for ejecting a liquid, an insulating layer covering the heating resistance element, a conductive protecting layer provided on or above the insulating layer and whose surface is exposed to the flow passage; and an intermediate layer provided between the flow passage forming member and the conductive protecting layer, wherein the intermediate layer contains a material represented by the following composition formula (I):

$$Si_{w1}O_{x1}C_{y1} \quad (I)$$

in formula (I), 39≤w1≤62 at. %, 32≤x1≤55 at. %, 6≤y1≤29 at. %, and w1+x1+y1=100 at %.

11. A liquid ejection head substrate comprising:

a flow passage forming member having an ejection orifice and a flow passage;

a heating resistance element for ejecting a liquid;

an insulating layer covering the heating resistance element;

a conductive protecting layer provided on or above the insulating layer and whose surface is exposed to the flow passage; and an intermediate layer provided between the flow passage forming member and the conductive protecting layer, wherein the intermediate layer contains a material represented by the following composition formula (III):

$$Si_{w3}O_{x3}C_{y3}N_{z3} \quad (III)$$

in formula (III), 37≤w3≤60 at. %, 30≤x3≤53 at. %, 6≤y3≤29 at. %, 4≤z3≤9 at. %, and w3+x3+y3+z3=100 at %.

12. The liquid ejection head substrate according to claim 11, wherein w3, x3, y3, and z3 in the composition formula (III) satisfy the following relational formula:

37≤w3≤39 at. %,

33≤x3≤41 at. %,

12≤y3≤22 at. %, and

7≤z3≤8 at. %.

13. The liquid ejection head substrate according to claim 11, wherein the intermediate layer has a layer made of the material represented by the composition formula (III), and a film thickness of the intermediate layer is 100 nm or more.

14. The liquid ejection head substrate according to claim 11, wherein a film thickness of the intermediate layer is 300 nm or less.

15. The liquid ejection head substrate according to claim 11, wherein the conductive protecting layer contains tantalum.

16. The liquid ejection head substrate according to claim 11, wherein the conductive protecting layer contains iridium.

17. The liquid ejection head substrate according to claim 11, further comprising:

an organic intermediate layer between the flow passage forming member and the intermediate layer.

* * * * *